US008011139B2

(12) United States Patent
Cashman

(10) Patent No.: US 8,011,139 B2
(45) Date of Patent: Sep. 6, 2011

(54) RAPID INSTALL MANTLE

(76) Inventor: Daniel J. Cashman, Suffield, CT (US)

( * ) Notice: Subject to any disclaimer, the term of this patent is extended or adjusted under 35 U.S.C. 154(b) by 174 days.

(21) Appl. No.: 12/383,985

(22) Filed: Mar. 31, 2009

(65) Prior Publication Data

US 2010/0242384 A1 Sep. 30, 2010

(51) Int. Cl.
*F24B 1/197* (2006.01)
*F24B 1/198* (2006.01)

(52) U.S. Cl. ..... 52/36.3; 52/37; 52/204.54; 52/212; 52/718.01; 126/544; D23/404

(58) Field of Classification Search ..... 52/36.3, 52/37, 204.1, 204.2, 204.5, 204.53, 211, 52/236.6, 236.7, 287.1, 716.1, 716.2, 716.8, 52/718.01, 718.04, 718.05, 718.06, 718.02, 52/718.03, 717.03, 717.04, 717.05, 717.06; D23/404; 126/500, 544; *F24B 1/18, 1/195, F24B 1/197, 1/198*
See application file for complete search history.

(56) References Cited

U.S. PATENT DOCUMENTS

| | | | | | |
|---|---|---|---|---|---|
| 420,775 | A * | 2/1890 | Dambach | 52/36.3 |
| 591,358 | A * | 10/1897 | Parker | 52/36.3 |
| 827,369 | A * | 7/1906 | Holbein et al. | 52/36.3 |
| 3,224,429 | A * | 12/1965 | Quittner | 126/551 |
| 4,254,596 | A * | 3/1981 | Wright et al. | 52/36.3 |
| 4,821,472 | A * | 4/1989 | Tix | 52/204.55 |
| 4,873,803 | A * | 10/1989 | Rundo | 52/202 |
| 4,999,957 | A * | 3/1991 | Kessler | 52/213 |
| 5,069,013 | A * | 12/1991 | Pliml, Jr. | 52/214 |
| 5,119,603 | A * | 6/1992 | Jones | 52/36.3 |
| 5,397,093 | A * | 3/1995 | Chubb et al. | 248/544 |
| 5,572,840 | A * | 11/1996 | Fast et al. | 52/213 |
| 6,112,481 | A * | 9/2000 | Schiedegger et al. | 52/211 |
| 6,161,344 | A * | 12/2000 | Blanchett | 52/97 |
| 6,295,777 | B1 * | 10/2001 | Hunter et al. | 52/519 |
| 6,371,188 | B1 * | 4/2002 | Baczuk et al. | 160/92 |
| 6,796,088 | B2 * | 9/2004 | Richmond et al. | 52/36.3 |
| 6,904,726 | B2 * | 6/2005 | Heard et al. | 52/211 |
| 6,932,310 | B1 * | 8/2005 | Diss | 248/301 |
| 7,146,774 | B2 * | 12/2006 | Fredette | 52/656.6 |
| 2004/0206025 | A1 * | 10/2004 | Panto | 52/211 |
| 2009/0205263 | A1 * | 8/2009 | Heath et al. | 52/36.3 |

FOREIGN PATENT DOCUMENTS

| | | | |
|---|---|---|---|
| FR | 2589191 | A1 * | 4/1987 |
| JP | 05141078 | A * | 6/1993 |

* cited by examiner

*Primary Examiner* — Brian E Glessner
*Assistant Examiner* — Joseph J Sadlon
(74) *Attorney, Agent, or Firm* — Alix, Yale & Ristas, LLP

(57) ABSTRACT

A prefabricated mantle unit has a base (36, 40) and a top plate (44) extending forwardly from the top of the base. A decorative strip (56) is oriented obliquely between the front of the top plate and the bottom of the base, with the lower edge (48) of the strip and the bottom (54) of the base forming a lower channel (50). The top element (16) of the surround (12) and the nailing flange (28) of the window box project above the top edge (24) of the window box, forming a box channel (26). The upward projection (22) of the top element is received within the lower channel (50) of the mantle unit, and a downward projecting portion (54) of the mantle base is received within the box channel (26).

18 Claims, 1 Drawing Sheet

RAPID INSTALL MANTLE

BACKGROUND

The present invention relates to building construction, and more particularly, to decorative mantles attachable to the top of exterior window surrounds.

In the construction or renovation of buildings prefabricated decorative mantels or headers provide a cost effective technique for enhancing the curb appeal of the building. Such decorative mantles can be fabricated by a supplier and delivered to the building site for installation before or after the wall exterior siding, depending on the type of window box, widow surround, and whether the siding is wood or vinyl. The mantles can be made of wood or cellular PVC. The latter is often preferred, because raw material of the desired color can be purchased, cut, and seam welded into intricate decorative designs.

With conventional mantles of this kind, the installer drills pilot holes through for screwing or nailing the post against the walls. A careful installer would try to minimize the visibility of the fastening penetrations, but especially with pre-colored mantles, any touch-up required after the installation adds to the labor cost of what should be a simple and straight forward installation.

Conventionally, a prefabricated mantle unit is placed over the top of a window surround, and screwed or nailed to the wall without engaging the window surround.

SUMMARY

According to the present disclosure, a prefabricated window mantle or header engages the window unit without nails or screws, while being nailed or screwed to the wall, thereby adding stability and support, and presenting a smooth, clean interface between mantle and window surround.

Such prefabricated mantle unit includes a base and a top plate extending forwardly from the top of the base. A decorative strip having upper and lower edges is oriented obliquely between the front of the top plate and the bottom of the base. A first channel opens downwardly adjacent the lower edge of the strip, and a downward projection extends from the base adjacent the first channel. The channel and the projection of the mantle engage a mating projection and channel, respectively, associated with the window.

Preferably, the mantle unit has a base and a top plate extending forwardly from the top of the base. A decorative strip is oriented obliquely between the front of the top plate and the bottom of the base, with the lower edge of the strip and the bottom of the base forming a lower channel. The top element of the surround and the nailing flange of the window box project above the top edge of the window box, forming a box channel. The upward projection of the top element is received within the lower channel of the mantle unit, and a downward projecting portion of the mantle base is received within the box channel.

In this manner, the lower portion of the mantle unit is intimately and positively inter-engaged with the window unit, whereby the mating of two projections with two channels over the full horizontal width of the window unit provides great stability and lessens the vertical load imposed on the screws or nails for supporting the mantle unit. Furthermore, with the lower edge of the decorative strip forming the front wall of the front channel, which receives the top element of the window surround, relatively large tolerances in the top element of the window surround can be accommodated while maintaining a clean line at the bottom edge of the decorative strip.

BRIEF DESCRIPTION OF THE DRAWING

A preferred embodiment will be described with reference to the accompanying drawing, in which.

DETAILED DESCRIPTION

Figure 1:
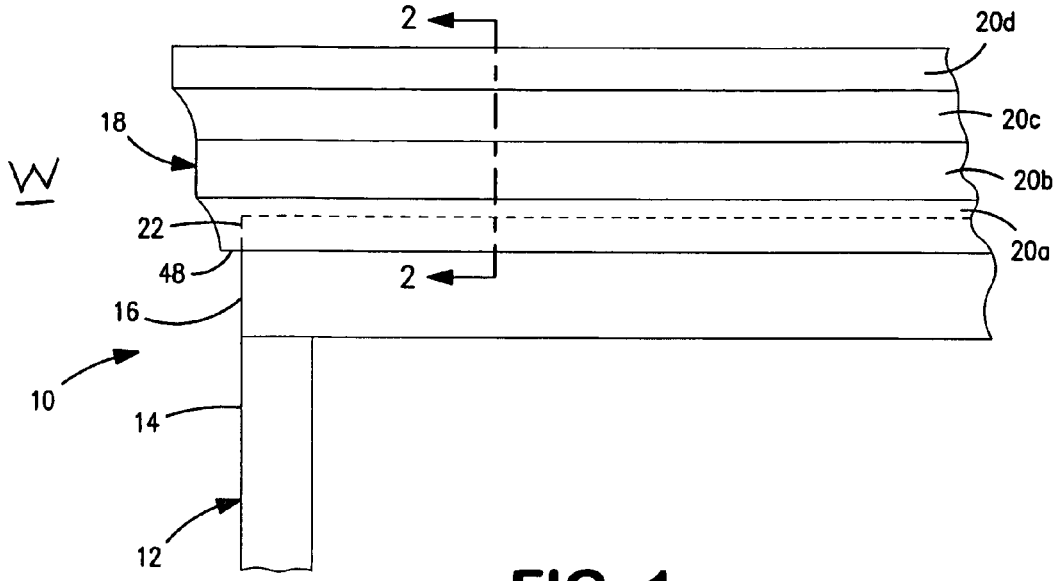
FIG. 1 is a schematic representation of an upper left corner of an exterior window with an associated mantle in accordance with the present disclosure.
Figure 2:
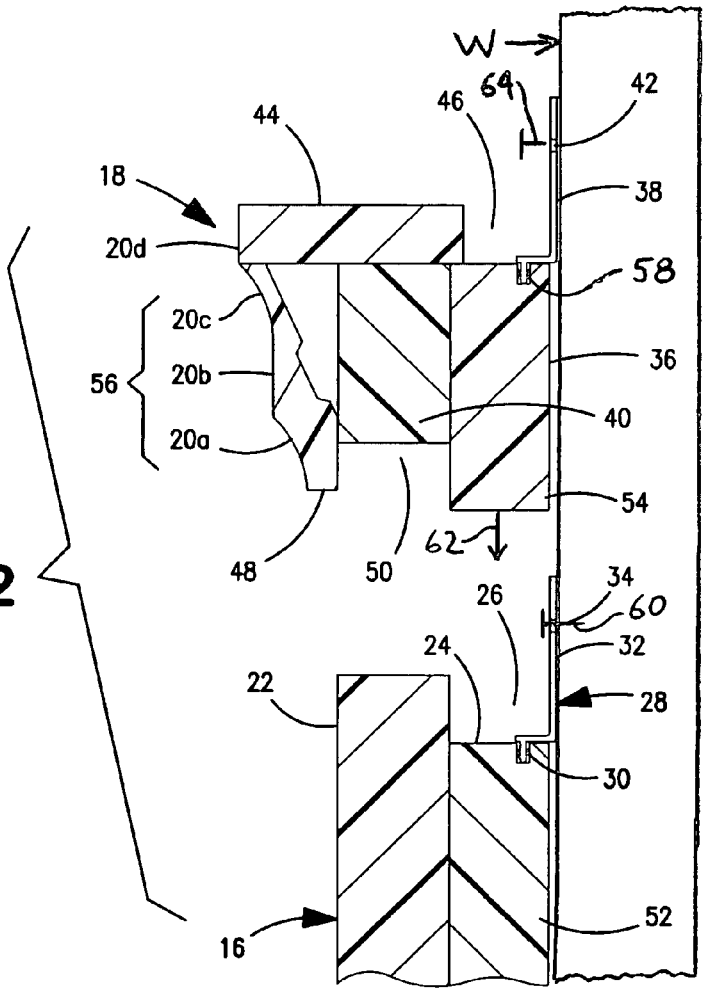
FIG. 2 is a hybrid view from the right of FIG. 1 as indicated by the lines 2-2, as the mantle unit is situated above the window unit during installation.

FIG. 1 shows a portion of a window system 10 installed on the exterior wall W of a building, and FIG. 2 shows the salient components thereof during installation. The portion of the window surround 12 shown in FIG. 1, comprises one of the two vertical side elements 14 and the horizontal top element 16. A decorative mantle unit 18 extends horizontally above the top element 16, and typically has an angled front face comprising a plurality of staggered surfaces as indicated at 20*a*, 20*b*, 20*c*, and 20*d*. According to an aspect of the present disclosure, the mantle unit 18 overlaps the upper edge 22 of the top element 16 (as shown in phantom in FIG. 1).

The top edge 22 of the top element projects above the top edge 24 of the window box to which the surround is attached. As used herein, "window unit" means the combination of window surround 12 and window box (a portion of which is indicated at 52) substantially as represented in the lower portion of FIG. 2. A nailing flange 28 extends upwardly from the window box, forming a channel 26 between the projection 22 of the top element 16 and the flange 28. Preferably, the flange 28 has a fin or the like that enters a groove 30 on the upper edge 24, such that the interference or press fit rigidly connects the flange to the back surface of the window box. The flange has a top portion 32 that rises vertically, with a plurality of horizontally spaced nail holes 34 therein, at an elevation above the top edge 22 of the top element 16.

The mantle unit 18 has a base 36, which as shown has two joined members 36, 40, but it should be understood that the base could be unitary. A nailing flange 38 extends vertically upwardly from the top of the base, connected thereto via groove 58, and having nail holes 42. A top piece 44 extends horizontally forward from the top of the base, with a vertical back edge spaced from the nailing flange 38, thereby forming a horizontal channel 46 at the top and toward the back of the base. The top piece 44 forms the uppermost front face 20*d* of the decorative portion of the mantle unit. The remainder of the decorative portions are formed by a preferably unitary strip 56 extending obliquely from a connection at the front underside of the top plate 44, to the bottom front of the base portion 40. It can thus be understood that the decorative strip 56 has top and bottom edges and is oriented obliquely between the front of the top plate and the bottom of the base, whereby the lower edge 48 of the strip and the bottom of the base 40 form a lower channel 50.

Preferably, a back wall of the lower channel 50 is formed by a projection 54 at the bottom of the base, such as by an extension of base portion 36, and a front wall of the channel 50 is defined by the bottom edge 48 of the decorative strip 56, with the front wall of the lower channel being shorter than the back wall. It should be appreciated, however, that although this configuration is the easiest to fabricate, an equivalent structure would have the lower channel 50 formed entirely as a notch in the lower front portion of a unitary base, with the edge 48 of the decorative piece 56 connected to a front wall of the channel formed by the base itself (not shown). In the illustrated embodiment, wherein the base is formed by two rectangular blocks 36, 40, block 36 defines (a) the back surface of the base to be placed against the building wall W, (b) the top of the base, and thereby forms the floor of the upper channel 46, and (c) via rectangular extension 54, the back wall of the lower channel 50. The other block 40 is rigidly connected to the lower edge 48 of the strip and defines the floor of the lower channel 50. Although not critical, it is preferred that the back of the top plate 44 entirely cover block 40 and extend slightly over the top of block 36.

For compatibility with materials used in typical window unit construction, channel 50 preferably has a width in the range of ¾ inch to 1 inch, and channel 26 has a similar width in the range of about ¾ inch to 1 inch. The corresponding projections 22 and 54 should likewise have a similar width. The depth of the channels 50, 26, and length of projections 22, 54 should also be compatible with conventional construction e.g., the typical projection of the upper edge 22 of a window surround over the associated top edge 24 of the upper element 52 of the window box. Regardless of the actual dimensions, the widths of the channels 50, 26 and projections 22, 54 should be such that when the mantle unit 18 is placed over and lowered down onto the window unit as shown in FIG. 2, a close engagement of the channels with their associated projections is achieved, over the full horizontal width of the unit, producing the appearance as shown in FIG. 1.

It should be appreciated that the mantel unit 18 is closed at its lateral ends and that the internal surfaces of these ends are visible but not cross-hatched in three regions as depicted in FIG. 2, i.e., at the end of channel 46, at the end of channel 50, and in the substantially triangular space between the strip 56 and the front surface of the base portion 40.

It should be understood that at the moment of installation depicted in FIG. 2, the window unit has already been secured to the wall W, at least in part with nails 60 through the nailing flange 28, which would be provided around at least the top and two vertical sides of the window box. The channel 26 formed therein is normally used for receiving vinyl siding elements, and thereafter the mantle units are secured over the siding. With the present invention, the mantle unit 18 is shifted downwardly as indicated at 62 and fits within the channel 26, as well as over the projection 22 of top element 16, and the mantle element 18 is then secured to the wall with nails 64 via nailing flange 38. The channel 46 on the mantle unit 18 now provides the recess for receiving the siding elements. As previously described with respect to FIG. 1, when the mantle unit 18 is fully installed, the lower edge 48 of the decorative strip 56 overlaps the upper edge 22 of the top element 16.

The foregoing description is with respect to the mantle unit 18 as would be preferred for use with a window unit on a building having exterior walls that are to be covered by vinyl siding. If the siding were to be wood, the channel 46 is not necessary, and the top plate 44 could extend to the nailing flange 38. In general, where present, the width of the upper channel 46 would be in the range of about ¾ inch to 1 inch.

What is claimed:

1. A prefabricated mantle unit for mating with a horizontal top element of a window surround, comprising:

a base having a top, a bottom, a front, and a flat vertical back surface;

a top plate having a horizontal top, a bottom, a front, and a back, said top plate extending horizontally forward from the top of the base;

a decorative strip having a plurality of staggered surfaces between upper and lower edges and oriented obliquely between the front of the top plate and the bottom of the base, wherein the strip is connected to the bottom of the base and the upper edge is connected to the top plate such that the front of the top plate and the strip together present a decorative face of the mantle;

a first channel opening downwardly adjacent the lower edge of the strip;

a downward rectangular projection from said base adjacent the first channel; and a nailing flange extending vertically from the top of the base and substantially coplanar with the back surface of the base, whereby the back of the top plate, the top of the base, and the nailing flange form a second channel.

2. The mantle unit of claim 1, wherein the lower edge of the strip and a wall of said projection from the base form said first channel.

3. A prefabricated mantle unit for mating with a horizontal top element of a window surround, comprising:

a base having a top, a bottom, a front, and a flat vertical back surface;

a top plate having a top, a bottom, a front, and a back, said top plate extending forwardly from the top of the base;

a decorative strip having top and bottom edges and oriented obliquely between the front of the top plate and the bottom of the base wherein the strip is connected to the bottom of the base and the top edge is connected to the top plate such that the front of the top plate and the strip together present a decorative face of the mantle, and wherein the lower edge of the strip and the bottom of the base form a lower channel; and a nailing flange extending vertically upwardly from the top of the base and substantially coplanar with the back surface of the base, whereby the back of the top plate, the top of the base, and the nailing flange form an upper channel.

4. The mantle unit of claim 3, wherein the lower channel has a width of about ¾ inch to one inch.

5. The mantle unit of claim 3, wherein the upper channel has a width of about ¾ inch to one inch.

6. The mantle unit of claim 4, wherein the upper channel has a width of about ¾ inch to one inch.

7. The mantle unit of claim 3, wherein a back wall of the lower channel is formed by a rectangular projection at the bottom of the base and said projection has a width of about ¾ inch to one inch.

8. The mantle unit of claim 3, wherein the lower channel has a depth of about ¼ inch to one inch.

9. The mantle unit of claim 3, wherein a back wall of the lower channel is formed by a projection at the bottom of the base;

a front wall of the lower channel is defined by the bottom edge of the decorative strip; and the front wall of the lower channel is shorter than the back wall.

10. The mantle unit of claim 3, wherein the base is formed by two rigidly connected rectangular blocks.

11. The mantle unit of claim 10, wherein one of said two blocks defines (i) the back surface of the base, (ii) said top of the base, thereby forming a floor of the upper channel, and (iii) a back wall of the lower channel; and the other of said two blocks is rigidly connected to the decorative strip and defines a floor of the lower channel.

12. The mantle unit of claim 3 in combination with said top element of a window surround, wherein said top element comprises a horizontal board having a top edge, a front face, and a back face, wherein the back face of the top element is attached to a front face of a window box element having a top edge and a back face;

another nailing flange extends upwardly and substantially coplanar with the back face of the window box element;

the top element and the nailing flange project above the top edge of the window box element, whereby a portion of the top element, a portion of the nailing flange, and the top edge of the box element form a box channel;

the projecting top element is received in close engagement within the lower channel of the mantle unit; and a back wall of the lower channel of the mantle unit is formed by a projection at the bottom of the base and said projection is received in close engagement within the box channel.

13. The mantle unit of claim 12, wherein the lower channel and the top edge of the top element have substantially the same width in the range of about ¾ inch to one inch.

14. The mantle unit of claim 12, wherein the upper channel has a width of about ¾ inch to one inch.

15. The mantle unit of claim 13, wherein the upper channel has a width of about ¾ inch to one inch.

16. The mantle unit of claim 12, wherein the projection forming the back wall of the lower channel and the box channel have substantially the same width in the range of about ¾ inch to one inch.

17. The mantle unit of claim 13, wherein the projection of the top element forms a front wall of the box channel and the back wall of the lower channel and the front wall of the box channel have substantially the same height.

18. The mantle unit of claim 12, wherein the lower edge of the decorative strip overlaps the upper edge of the top element.

* * * * *